US006438810B2

(12) United States Patent
Rogers, Jr. et al.

(10) Patent No.: US 6,438,810 B2
(45) Date of Patent: Aug. 27, 2002

(54) SEAT RESTRAINT BUCKLE ASSEMBLY

(75) Inventors: Lloyd Walker Rogers, Jr., Shelby Township; John R. Rice, Clinton Township; David Gerard Hlavaty, Northville; James Lloyd Webber, Shelby Township, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/740,574

(22) Filed: Dec. 18, 2000

Related U.S. Application Data

(63) Continuation-in-part of application No. 09/476,150, filed on Dec. 30, 1999, now abandoned.

(51) Int. Cl.[7] ..... A44B 11/25
(52) U.S. Cl. ..... 24/641; 24/636; 24/633
(58) Field of Search ..... 24/641, 633, 639, 24/640, 642, 637, 645, 643, 196; 280/806

(56) References Cited

U.S. PATENT DOCUMENTS 4,391,024 A 7/1983 Morinaga
4,454,634 A * 6/1984 Haglund et al. ..... 24/636
4,527,317 A * 7/1985 Straszewski et al. ..... 24/641
5,163,207 A * 11/1992 Krautz et al. ..... 24/633

FOREIGN PATENT DOCUMENTS

| | | | |
|---|---|---|---|
| EP | 0083752 | A2 | 7/1983 |
| EP | 0212507 | A2 | 3/1987 |
| EP | 1018307 | A1 | 7/2000 |
| GB | 2173243 | A | 10/1986 |
| GB | 2271377 | A | 4/1994 |

* cited by examiner

*Primary Examiner*—Robert J. Sandy
(74) *Attorney, Agent, or Firm*—Kathryn A. Marra

(57) ABSTRACT

A seat restraint buckle assembly for a seat restraint system in a vehicle includes a rigid frame having an open forward end defining a passage to receive a latch plate. The seat restraint buckle assembly also includes a locking member operatively connected to the frame and pivotal between a latched position in which the locking member retains the latch plate within the passage and an unlatched position in which the locking member is held clear of the passage. The seat restraint buckle assembly includes a release button slidably mounted on the frame above the passage for longitudinal movement relative to the frame. The seat restraint buckle assembly further includes a blocking lever operatively connected to the frame and pivotal to contact the locking member and urging the locking member towards the latched position. The seat restraint buckle assembly also includes a spring disposed between the blocking lever and the release button to rotate the blocking lever to lock-up the locking member in the latched position.

20 Claims, 8 Drawing Sheets

SEAT RESTRAINT BUCKLE ASSEMBLY

CROSS-REFERENCE TO RELATED APPLICATION(S)

The present application is a Continuation-In-Part of application Ser. No. 09/476,150, filed Dec. 30, 1999 abandoned.

TECHNICAL FIELD

The present invention relates generally to seat restraint systems for vehicles and, more particularly, to a seat restraint buckle assembly for a seat restraint system in a vehicle.

BACKGROUND OF THE INVENTION

It is known to provide a seat restraint system such as a seat belt in a vehicle to restrain an occupant in a seat of the vehicle. In some vehicles, the seat restraint system may be a lap belt, a shoulder belt, or both. Typically, the lap belt and shoulder belt are connected together at one end. The seat restraint system includes a latch plate at the connected end. The seat restraint system also includes a buckle connected at one end by webbing or the like to vehicle structure. The buckle receives the latch plate to be buckled together. When the buckle and latch plate are buckled together, the seat restraint system restrains movement of the occupant to help protect the occupant during a collision.

Examples of seat restraint buckles for the seat restraint system are disclosed in U.S. Pat. No. 4,899,424 to Barnes et al. and U.S. Pat. No. 5,271,129 to Clarke et al., the disclosures of both are hereby incorporated by reference. However, these seat restraint buckles are not designed to work in conjunction with a seat belt pretensioner.

SUMMARY OF THE INVENTION

It is, therefore, one object of the present invention to provide a seat restraint buckle for a seat restraint system in a vehicle.

It is another object of the present invention to provide a seat restraint buckle for a seat restraint system in a vehicle that operates with a seat belt pretensioner and with an end release type buckle.

To achieve the foregoing objects, the present invention is a seat restraint buckle assembly for a seat restraint system in a vehicle including a rigid frame having an open forward end defining a passage to receive a latch plate. The seat restraint buckle assembly also includes a locking member operatively connected to the frame and pivotal between a latched position in which the locking member retains the latch plate within the passage and an unlatched position in which the locking member is held clear of the passage. The seat restraint buckle assembly further includes a release button slidably mounted on the frame above the passage for longitudinal movement relative to the frame. The seat restraint buckle assembly further includes a blocking lever operatively connected to the frame and pivotal to contact the locking member and urge the locking member towards the latched position when opposing forces are acting on the locking member. The seat restraint buckle assembly also includes a spring disposed between the blocking lever and the release button to rotate the blocking lever to lock-up the locking member in the latched position.

One advantage of the present invention is that a seat restraint buckle assembly is provided for a seat restraint system in a vehicle. Another advantage of the present invention is that the seat restraint buckle assembly enables the use of a seat belt pretensioner with fewer parts for a seat restraint system in a vehicle. Yet another advantage of the present invention is that the seat restraint buckle assembly allows incorporation of a seat belt pretensioner combination with an end release type buckle for a seat restraint system in a vehicle. Still another advantage of the present invention is that the seat restraint buckle assembly may be used with seat restraint systems having belt or buckle pretensioners.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
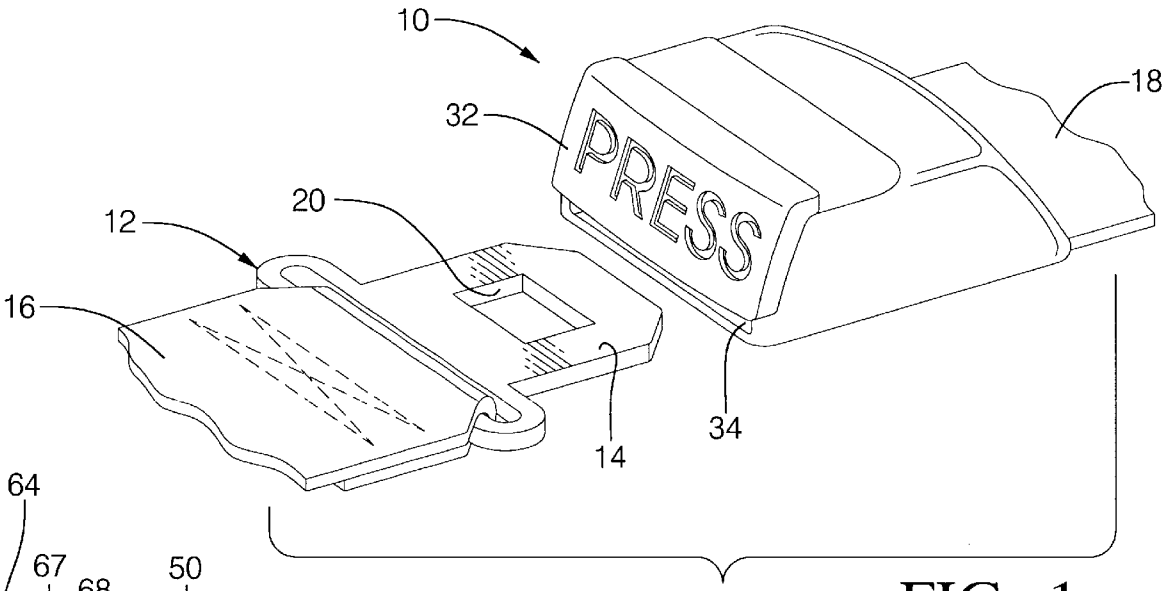
FIG. 1 is a perspective view of a seat restraint buckle assembly, according to the present invention, illustrated in operational relationship with a seat restraint system of a vehicle.
Figure 2:
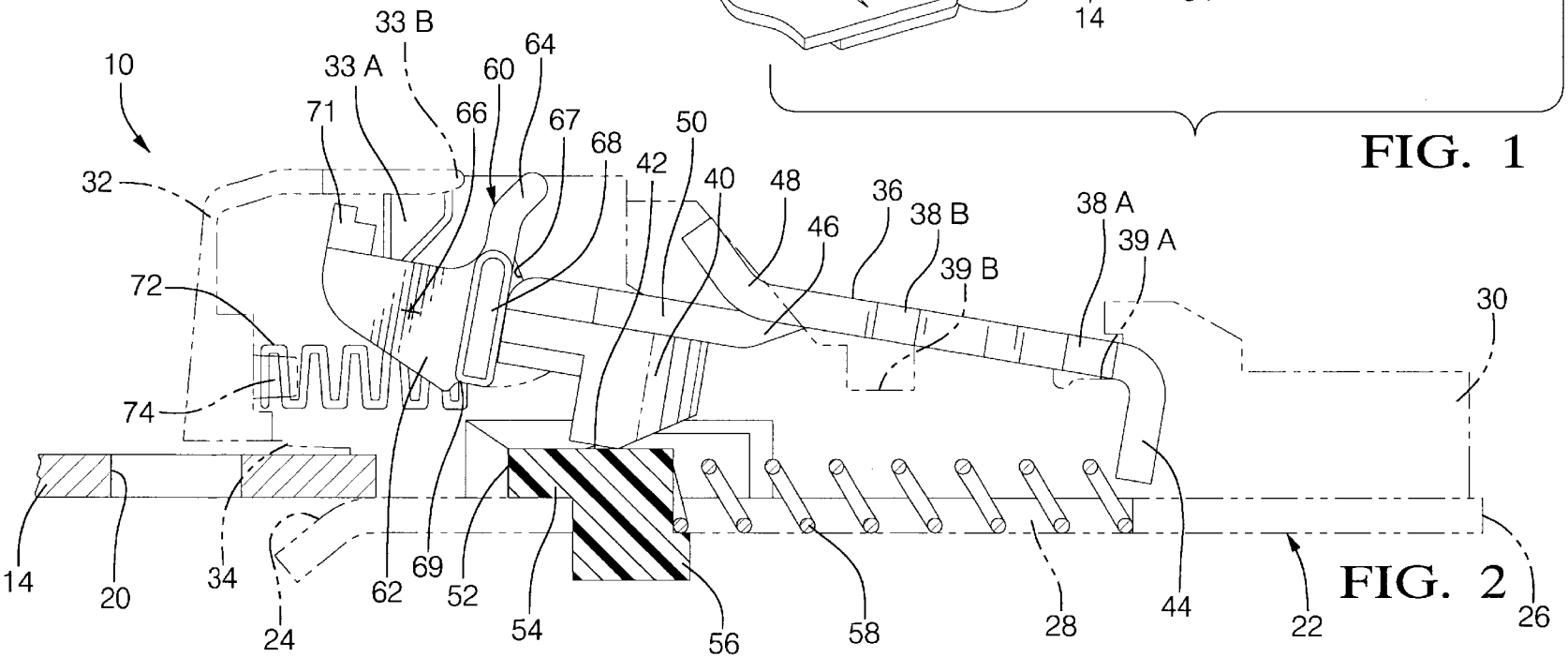
FIG. 2 is a fragmentary elevational view of the seat restraint buckle assembly of FIG. 1 illustrating an unbuckled position.
Figure 3:
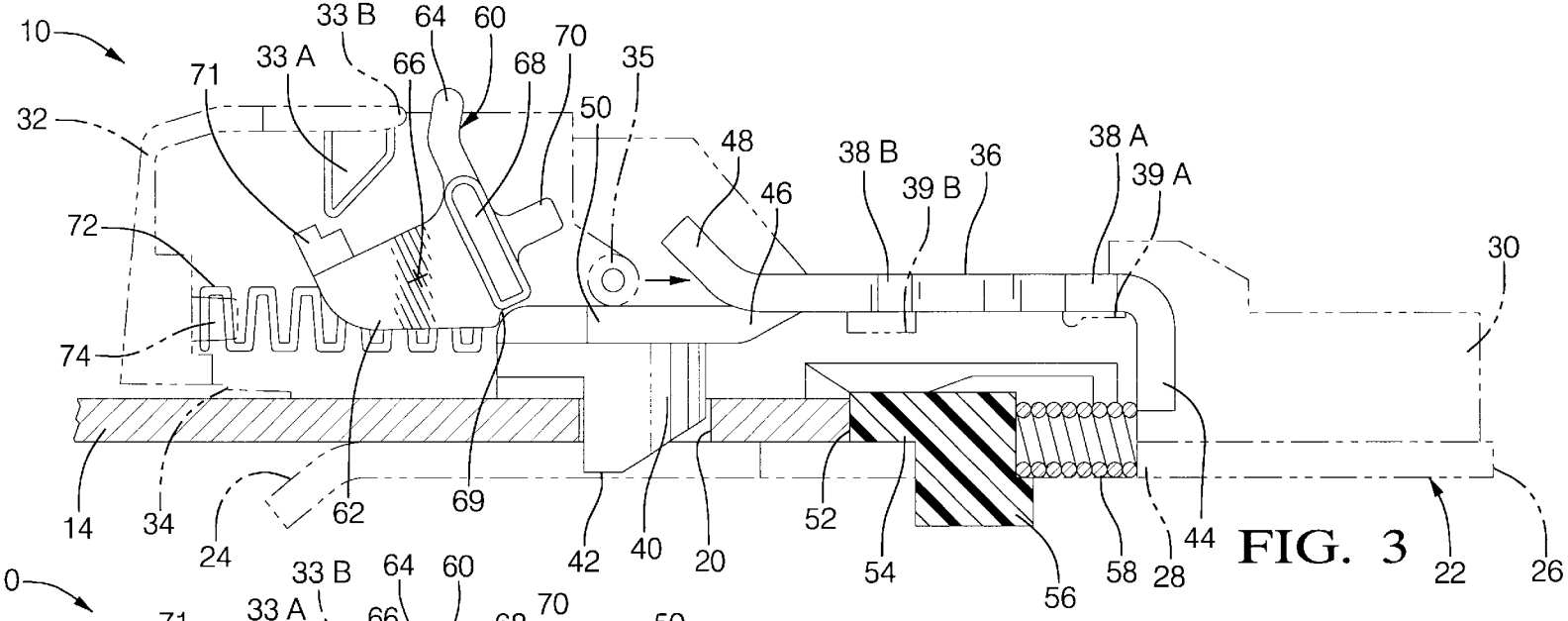
FIG. 3 is a view similar to FIG. 2 illustrating the seat restraint buckle assembly in a buckled position.
Figure 7:
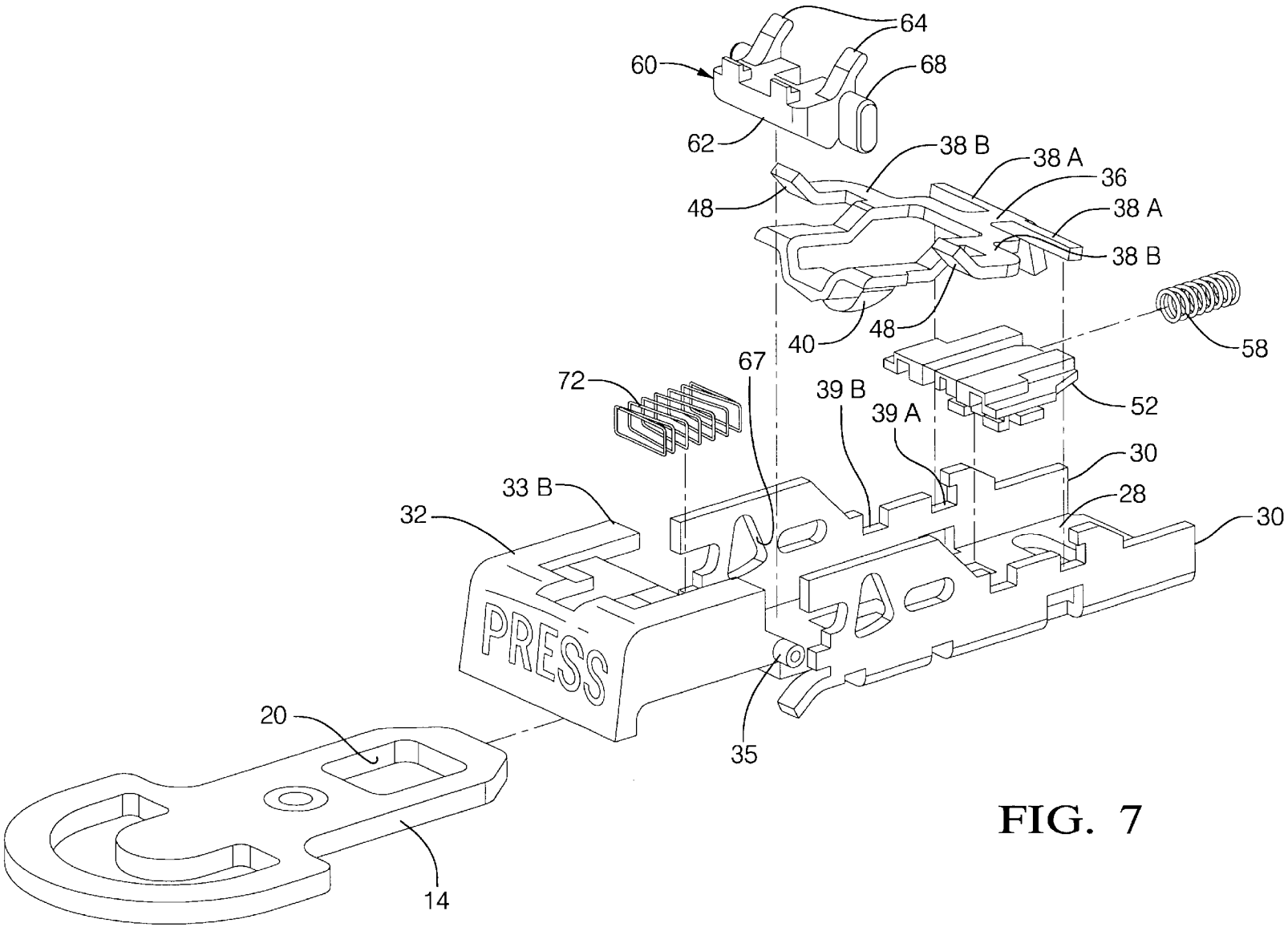
FIG. 7 is an exploded perspective view of the seat restraint buckle assembly of FIG. 1.
Figure 8:
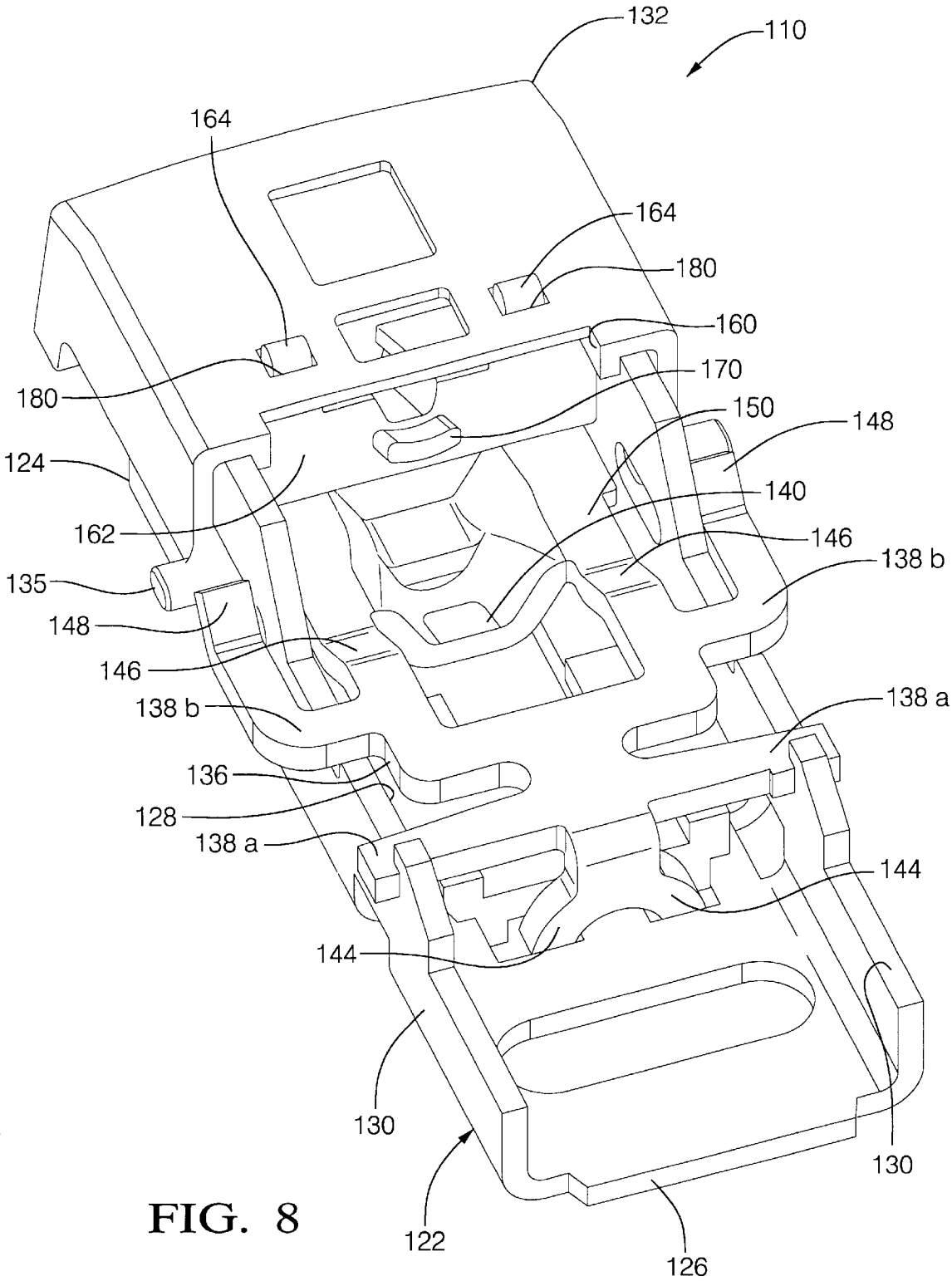
FIG. 8 is a perspective view of another embodiment, according to the present invention, of the seat restraint buckle assembly of FIG. 1.

Referring to the drawings and in particular FIGS. 1, 2, and 7, one embodiment of a seat restraint buckle assembly 10, according to the present invention, is shown for a seat restraint system, generally indicated at 12, in a vehicle (not shown). The seat restraint system 12 is used for restraining an occupant (not shown) in a seat (not shown) of the vehicle. The seat restraint system 12 includes a latch tongue or plate 14 connected to an end of a belt 16 such as a lap belt, shoulder belt, or both which have another end connected to a retractor (not shown). The seat restraint system 12 also includes the seat restraint buckle assembly 10 connected by suitable means such as belt webbing 18 to vehicle structure (not shown). The seat restraint system 12 may include a seat belt pretensioner (not shown) interconnecting the belt webbing 18 and the vehicle structure. The latch plate 14 has an aperture 20 extending therethrough and is engageable and disengageable with the seat restraint buckle assembly 10 as illustrated in FIGS. 2 and 3. It should be appreciated that, except for the seat restraint buckle assembly 10, the seat restraint system 12 is conventional and known in the art.

Referring to FIGS. 1 through 3, the seat restraint buckle assembly 10, according to the present invention, includes a rigid frame, generally indicated at 22, having an open forward end 24 and an opposite rearward end 26 attached to the belt webbing 18. The frame 22 also includes an apertured rectangular base plate 28 and side plates 30, each one of which extends longitudinally and upwards from a respective longitudinal edge of the base plate 28. It should be appreciated that the frame 22 is similar to that disclosed in U.S. Pat. No. 5,271,129 to Clarke et al.

The seat restraint buckle assembly 10 also includes a release or push button 32 slidably mounted between the side plates 30 for longitudinal movement with respect to, and substantially parallel with, the base plate 28. The release button 32 has a block-out portion 33*a* extending rearwardly and downwardly for a function to be described. The release button 32 also has a contact portion 33*b* extending rearwardly past the block-out portion 33*a* for a function to be described. The release button 32 is spaced apart from the base plate 28 so as to define a rectangular slot-like passage 34 therebetween at the open forward end 24 of the frame 22, to allow access of the latch plate 14 into the seat restraint buckle assembly 10. The release button 32 also includes a kick-out portion 35 extending rearwardly for a function to be described. The kick-out portion 35 extends transversely from each side and is generally cylindrical in shape.

The seat restraint buckle assembly 10 includes a latching paw or locking member 36 pivotally connected between the side plates 30. The locking member 36 is pivoted between the side plates 30 on integral rear wing portions 38*a*, each of which extends from a respective side of the locking member 36 and is located in an open pivot recess 39*a* in a respective side plate 30. The movement of the locking member 36 is stopped forwardly by integral forward wing portions 38*b*, each of which extends from a respective side of the locking member 36 and is located in an open stop recess 39*b*. The locking member 36 pivots about an axis extending across the space between the side plates 30 that is substantially parallel to the plane of the base plate 28. The locking member 36 pivots between a latched or buckled position of FIG. 3 in which an integral dependent lock bar 40 engages or is disposed in the aperture 20 of the latch plate 14 and an unlatched or unbuckled position of FIG. 2 in which the lock bar 40 is raised above or disengages the aperture 20 in the latch plate 14. As illustrated in FIG. 2, a bottom surface 42 of the lock bar 40 is raised above the passage 34 provided for the latch plate 14.

The locking member 36 has two dependent legs 44 that extend from adjacent the pivot axis of the locking member 36 to close to the base plate 28. The legs 44 move between the position shown in FIG. 3, where they are upright with respect to the base plate 28, to a forward, inclined position shown in FIG. 2, as the locking member 36 pivots between the latched and unlatched positions. The locking member 36 also includes a downwardly-cranked portion 46 forward of each wing portion 38 and a kick-out limb 48 extending forwardly and upwardly from each side. The kick-out limb 48 cooperates with the kick-out portion 35 of the release button 32 to rotate the locking member 36. The locking member 36 also has a substantially rectangular planar portion 50 extending forwardly from the two downwardly-cranked portions 46 to overlie the passage 34. The planar portion 50 carries the lock bar 40. As illustrated in FIG. 3, when the seat restraint buckle assembly 10 is in the latched position, planar portion 50 of the locking member 36 is substantially parallel to the base plate 28.

The seat restraint buckle assembly 10 includes an ejector or actuator slider 52 that is slidably mounted upon the base plate 28 for longitudinal movement within an aperture (not shown) in the base plate 28. The actuator slider 52 moves parallel to the direction of insertion of the latch plate 14 into the passage 34. The actuator slider 52 is symmetrically shaped about the longitudinal axis of the base plate 28. The actuator slider 52 has a main body portion 54 which slides upon an upper surface of the base plate 28 and a depending central portion 56 which is located within the aperture of the base plate 28. The seat restraint buckle assembly 10 also includes a spring 58 such as a helical coil spring which is located between a rearward end of the depending central portion 56 and a spring abutment (not shown) formed on the base plate 28. It should be appreciated that the actuator slider 52 and spring 58 are similar to that disclosed in U.S. Pat. No. 5,271,129 to Clarke et al.

Referring to FIGS. 1 through 7, the seat restraint buckle assembly 10 includes a blocking lever, according to the present invention and generally indicated at 60, for urging the seat restraint buckle assembly 10 towards the latched position upon deploying a seat belt pretensioner. The blocking lever 60 includes a main body portion 62 and a flange or detent portion 64 extending from the main body portion 62. The main body portion 62 has a center of gravity 66 and a blocking portion 68 extending laterally outwardly from the main body portion 62 and pivotal on cut-outs 67 in the side walls 30 of the frame 22. The blocking lever 60 further includes a step 69 between the blocking portion 68 and the main body portion 62 for cooperating with the locking member 36 in a manner to be described. The blocking lever 60 includes a stop 70 extending rearwardly from the main body portion 62 to contact the locking member 36 for a function to be described. The blocking lever 60 includes a step portion 71 extending forwardly and upwardly from the main body portion 62 for a function to be described. The blocking lever 60 is formed as a monolithic structure being integral, unitary and one-piece. It should be appreciated that the blocking lever 60 has the center of gravity 66 specifically located below its own pivot defined by the blocking portion 68 and a mass that is greater than the release button 32.

The seat restraint buckle assembly 10 includes a spring 72 extending longitudinally between the release button 32 and the blocking lever 60. The spring 72 is disposed over a projection 74 on the release button 32 and the blocking portion 68 of the blocking lever 60.

In normal operation, the seat restraint system 12 is illustrated in FIG. 2 in an unlatched or unbuckled position in which the latch plate 14 is removed from the seat restraint buckle assembly 10. To fasten or latch the seat restraint system 12, the latch plate 14 is inserted between the frame 22 and release button 32. The latch plate 14 contacts a leading surface on the actuator slider 52, compressing the spring 58, until the actuator slider 52 contacts the legs 44 of the locking member 36. As the latch plate 14 and actuator slider 52 continue to travel, the actuator slider 52 rotates the locking member 36 on the frame 22. The locking member 36 has the lock bar 40 that rotates and passes through the aperture 20 in the latch plate 14. As the locking member 36 rotates in a counterclockwise direction, a leading edge of the locking member 36 contacts the blocking lever 60 to rotate the blocking lever 60 in a clockwise direction. As the blocking lever 60 rotates, this rotation will compress the spring 72. As the locking member 36 rotates past the blocking lever 60, the stored energy in the spring 72 will act on the blocking lever 60 and rotate in a counterclockwise direction and the step 69 on the blocking lever 60 will lockup with the locking member 36. At this point, the seat restraint system 10 is in a latched or buckled position as illustrated in FIG. 3.

To unlatch the seat restraint system 12 during normal operation, an operator pushes or presses on the release button 32. The contact portion 33*b* of the release button 32 makes contact with the detent portion 64 on the blocking lever 60 and rotates the blocking lever 60 in a clockwise direction, which will then lose contact with the locking member 36. As the locking member 36 rotates in a clockwise direction about a pivot on the frame 22, this rotation will remove the locking member 36 from the latch plate 14. The stored energy in the spring 58 will then push the actuator slider 52 forward and push the latch plate 14 out of the buckle assembly 10 and become unlatched.

Figure 4:
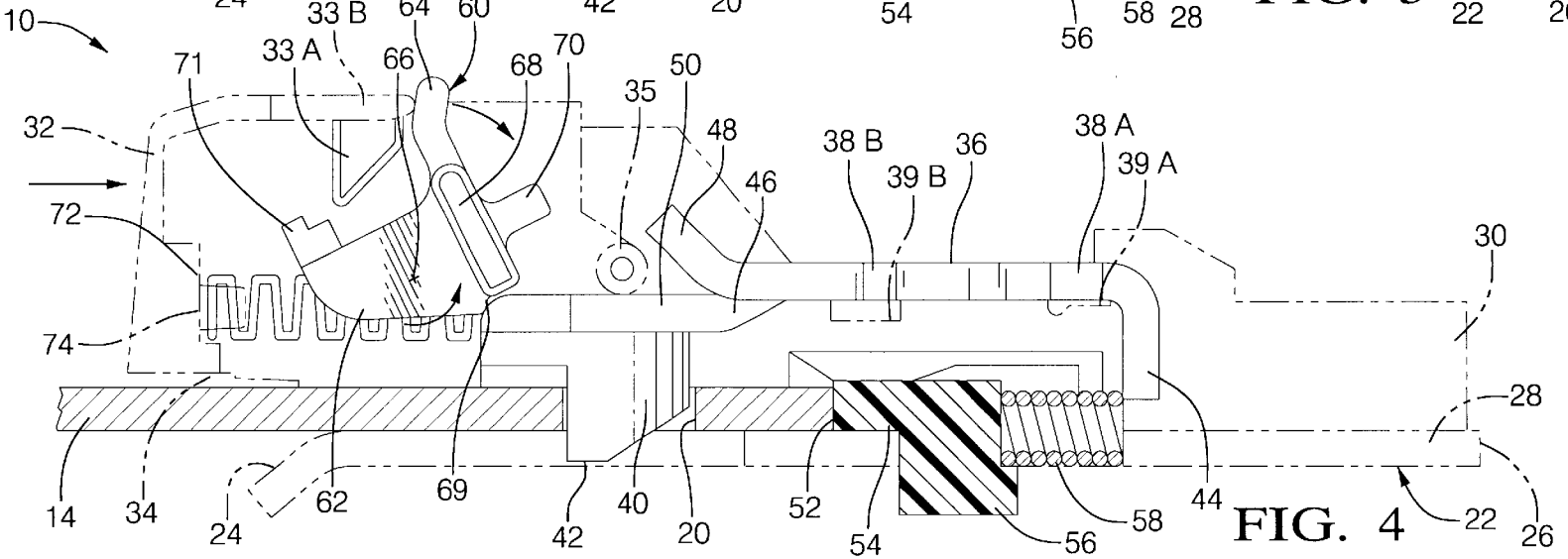
FIG. 4 is a view similar to FIG. 2 illustrating the seat restraint buckle assembly in a latched buckle button pre-travel position.

When the seat restraint system 12 is in the latched position of FIG. 3 and the seat belt pretensioner has been deployed, the seat restraint buckle assembly 10 will experience very high acceleration and very rapid deceleration. During acceleration of the seat restraint buckle assembly 10, the blocking lever 60 rotates in a clockwise direction as illustrated in FIG. 3. The step portion 71 rotates with the main body portion 62 and contacts the block-out portion 33*a* of the release button 32. During deceleration of the seat restraint buckle assembly 10, the release button 32 will translate in the axis of the seat restraint buckle assembly 10 and the block-out portion 33 makes contact with the blocking lever 60 and attempts to rotate the blocking lever 60 in a clockwise direction. The blocking lever 60, with a center of gravity that is specifically located below its own pivot defined by the pin 66 and a mass that is greater than the release button 32, will rotate in a counterclockwise direction. As a result, the blocking lever 60 will maintain a latched or locked condition with the locking member 36 and retain the latch plate 14 to provide positive latching of the seat restraint buckle assembly as illustrated in FIG. 4.

Figure 5:
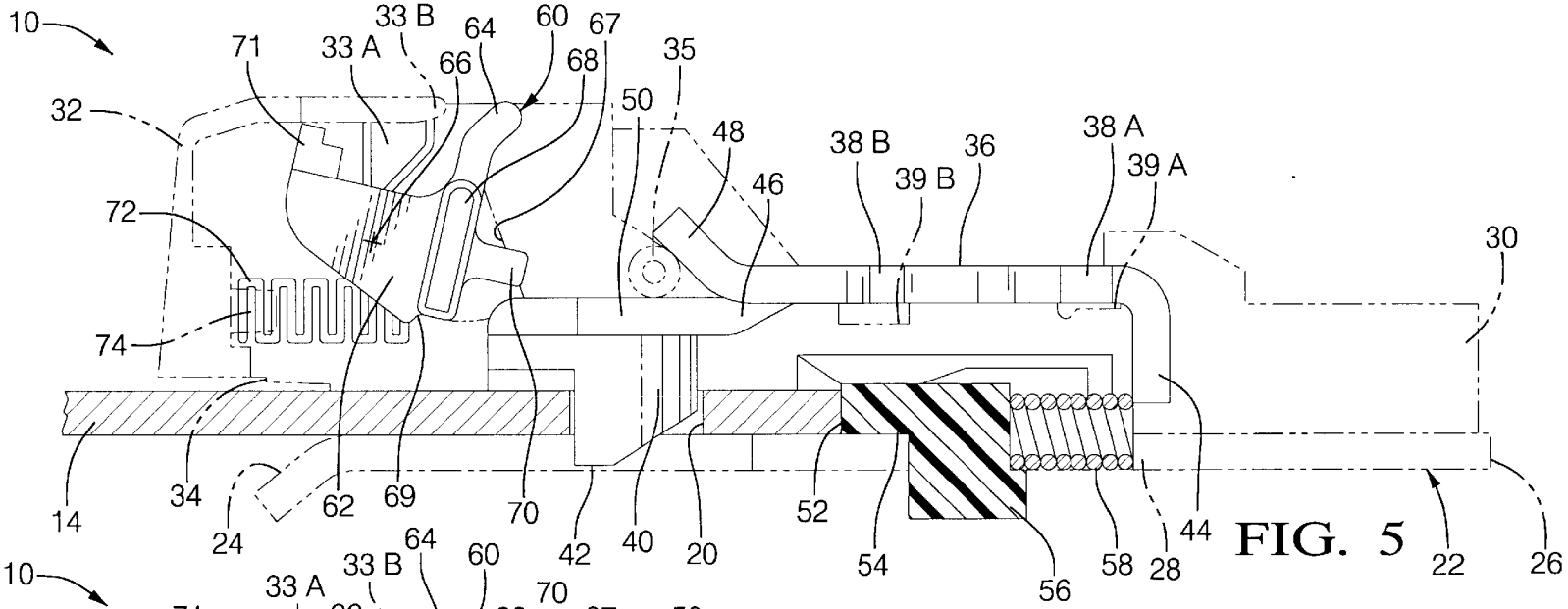
FIG. 5 is a view similar to FIG. 2 illustrating the seat restraint buckle assembly in an unlatched, buckle button full travel position.
Figure 6:
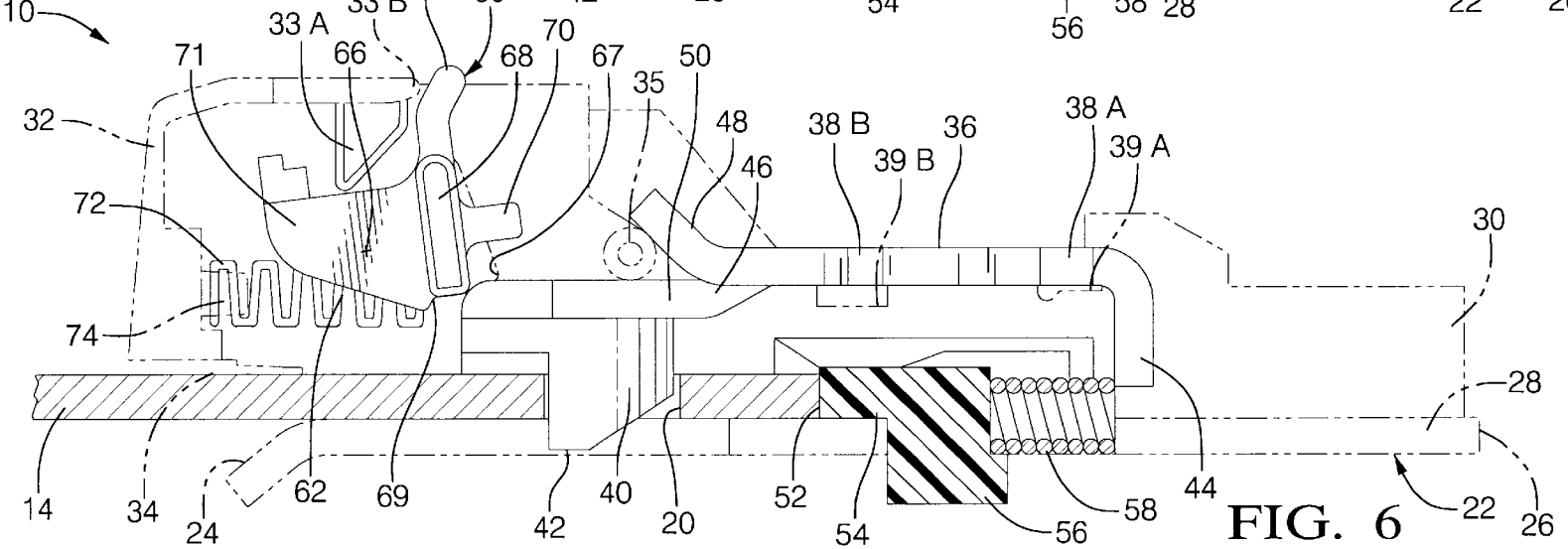
FIG. 6 is a view similar to FIG. 2 illustrating the seat restraint buckle assembly in a tip on tip, blocking lever to locking member position.

Unlatching the seat restraint system 12 after the seat belt pretensioner has fired and all motion of the vehicle has ceased as illustrated in FIG. 5, the operator pushes or presses on the release button 32. The contact portion 33*b* of the release button 32 makes contact with the detent portion 64 on the blocking lever 60 and rotates the blocking lever 60 in a clockwise direction, which will then lose contact with the locking member 36. As the locking member 36 rotates in a clockwise direction about a pivot on the frame 22, this rotation will remove the locking member 36 from the latch plate 14. The stored energy in the spring 58 will then push the actuator slider 52 forward and push the latch plate 14 out of the buckle assembly 10 and become unlatched. It should be appreciated that the mass of the release button 32 multiplied by the length of the pivot to button interface is less than the mass of the blocking lever 60 multiplied by length of the pivot to the center of gravity 66.

Referring to FIGS. 8 through 12, another embodiment, according to the present invention, of the seat restraint buckle assembly 10 is shown. Like parts of the seat restraint buckle assembly 10 have like reference numerals increased by one hundred (100). In this embodiment, the seat restraint buckle assembly 110 includes a rigid frame 122 having an open forward end 124 and an opposite rearward end 126 attached to the belt webbing 18. The frame 122 also includes an apertured rectangular base plate 128 and side plates 130, each one of which extends longitudinally and upwards from a respective longitudinal ege of the base plate 128. The seat restraint buckle assembly 110 includes a release or push button 132 slidably mounted between the side plates 130 for longitudinal movement with respect to, and substantially parallel with, the base plate 128. The release button 132 is spaced apart from the base plate 128 so as to define a rectangular slot-like passage 134 therebetween at the open forward end 124 of the frame 122, to allow access of the latch plate 14 into the seat restraint buckle assembly 110. The release button 132 also includes a kick-out portion 135 extending rearwardly for a function to be described. The kick-out portion 135 extends transversely from each side and is generally cylindrical in shape.

Figure 11:
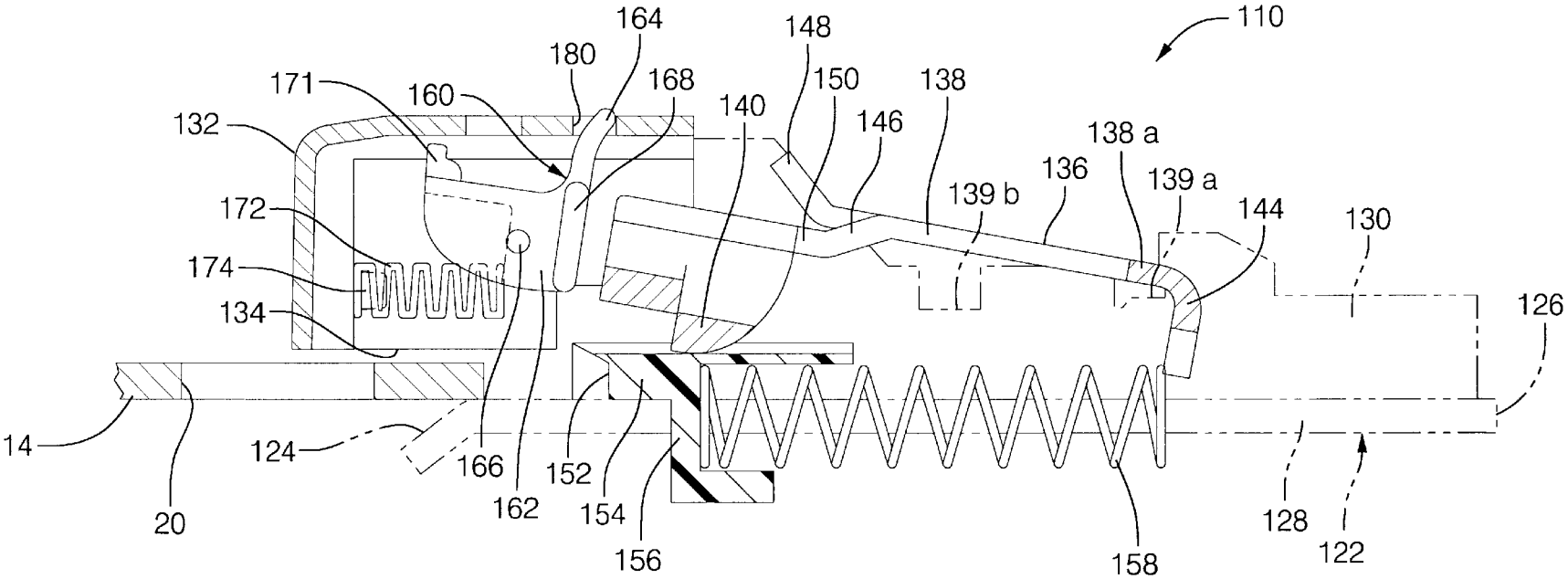
FIG. 11 is a view similar to FIG. 9 illustrating the seat restraint buckle assembly in an unbuckled position.
Figure 12:
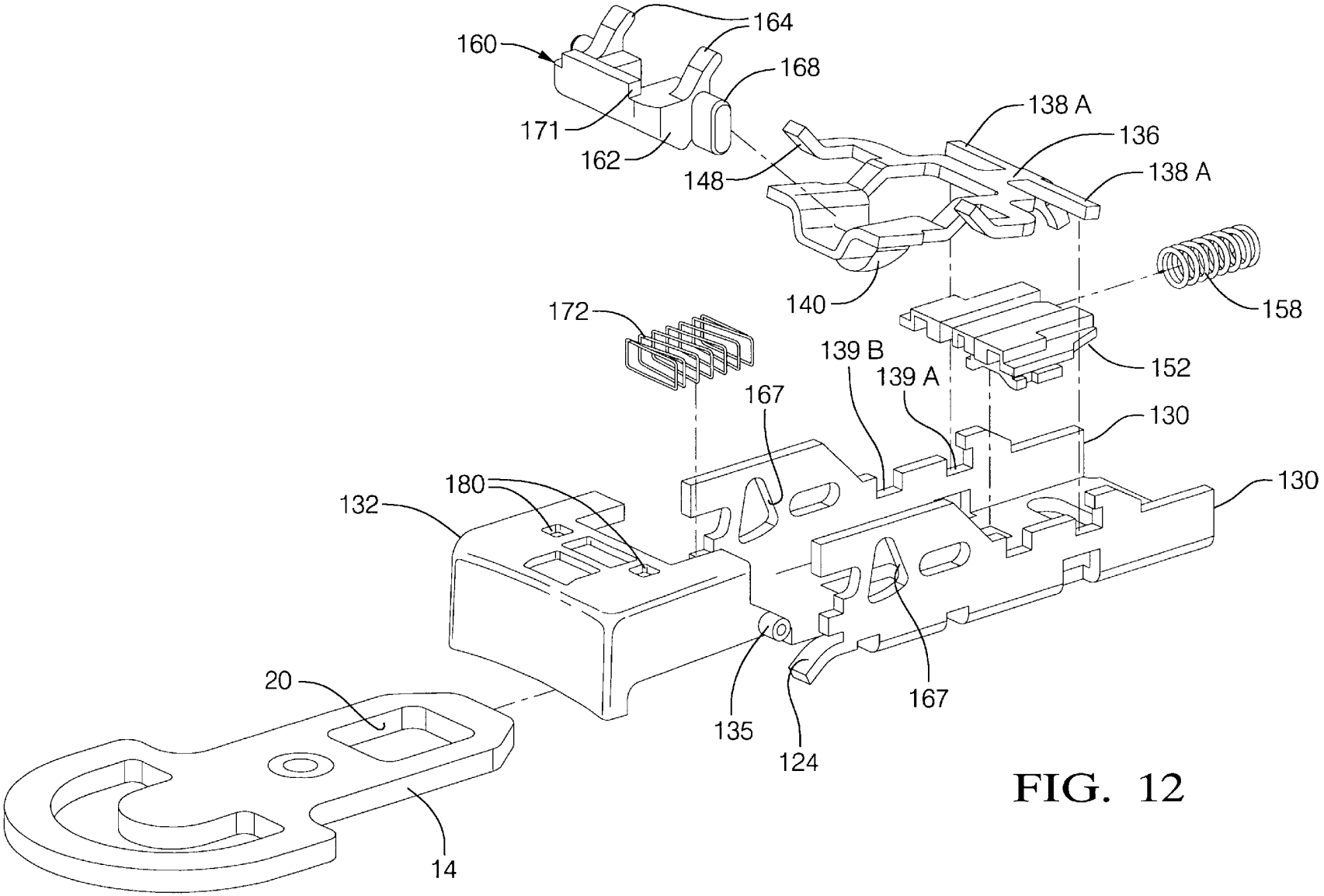
FIG. 12 is an exploded perspective view of the seat restraint buckle assembly of FIG. 8.

The seat restraint buckle assembly 110 includes a latching paw or locking member 136 pivotally connected between the side plates 130. The locking member 136 is pivoted between the side plates 130 on integral rear wing portions 138*a,* each of which extends from a respective side of the locking member 136 and is located in an open pivot recess 139*a* in a respective side plate 130. The movement of the locking member 136 is stopped forwardly by integral forward wing portions 138*b,* each of which extends from a respective side of the locking member 136 and is located in an open stop recess 139*b*. The locking member 136 pivots about an axis extending across the space between the side plates 130 that is substantially parallel to the plane of the base plate 128. The locking member 136 pivots between a latched or buckled position of FIG. 9 in which an integral dependent lock bar 140 engages or is disposed in the aperture 20 of the latch plate 14 and an unlatched or unbuckled position of FIG. 11 in which the lock bar 140 is raised above or disengages the aperture 20 in the latch plate 14. As illustrated in FIG. 11, a bottom surface 142 of the lock bar 140 is raised above the passage 134 provided for the latch plate 14.

Figure 9:
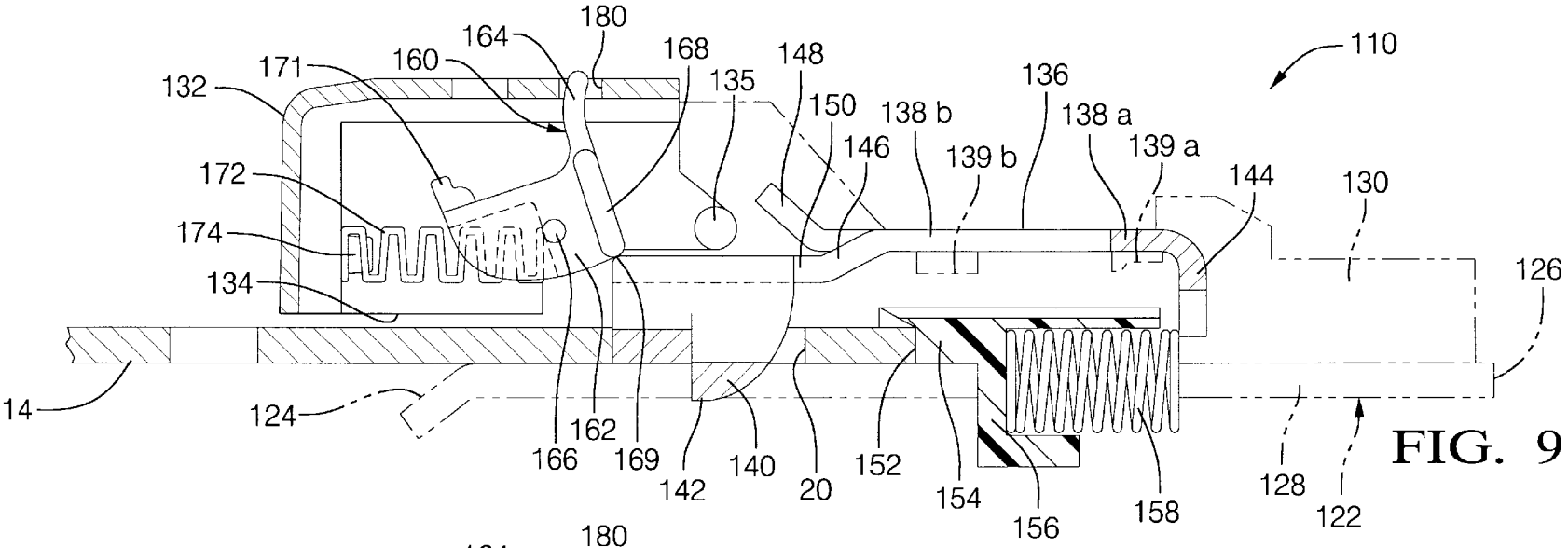
FIG. 9 is a fragmentary elevational view of the seat restraint buckle assembly of FIG. 8 illustrating a buckled position.

The locking member 136 has two dependent legs 144 that extend from adjacent the pivot axis of the locking member 136 to close to the base plate 128. The legs 144 move between the position shown in FIG. 9, where they are upright with respect to the base plate 128, to a forward, inclined position shown in FIG. 11, as the locking member 136 pivots between the latched and unlatched positions. The locking member 136 also includes a downwardly-cranked portion 146 forward of each wing portion 138 and a kick-out limb 148 extending forwardly and upwardly from each side. The kick-out limb 148 cooperates with the kick-out portion 135 of the release button 132 to rotate the locking member 136. The locking member 136 also has a substantially rectangular planar portion 150 extending forwardly from the two downwardly-cranked portions 146 to overlie the passage 134. The planar portion 150 carries the lock bar 140. As illustrated in FIG. 9, when the seat restraint buckle assembly 110 is in the latched position, planar portion 150 of the locking member 136 is substantially parallel to the base plate 128.

The seat restraint buckle assembly 110 includes an ejector or actuator slider 152 that is slidably mounted upon the base plate 128 for longitudinal movement within an aperture (not shown) in the base plate 128. The actuator slider 152 moves parallel to the direction of insertion of the latch plate 14 into the passage 134. The actuator slider 152 is symmetrically shaped about the longitudinal axis of the base plate 128. The actuator slider 152 has a main body portion 154 which slides upon an upper surface of the base plate 128 and a depending central portion 156 which is located within the aperture of the base plate 128. The seat restraint buckle assembly 110 also includes a spring 158 such as a helical coil spring which is located between a rearward end of the depending central portion 156 and a spring abutment (not shown) formed on the base plate 128. It should be appreciated that the actuator slider 152 and spring 158 are similar to that disclosed in U.S. Pat. No. 5,271,129 to Clarke et al.

The seat restraint buckle assembly 110 includes a blocking lever, according to the present invention and generally indicated at 160, for urging the seat restraint buckle assembly 110 towards the latched position upon deploying a seat belt pretensioner. The blocking lever 160 includes a main body portion 162 and at least one preferably a plurality of, more preferably two, flanges or detent portions 164 extending from the main body portion 162 and spaced laterally to extend through corresponding apertures 180 in the release button 132. The main body portion 162 has a center of gravity 166 and a blocking portion 168 extending laterally outwardly from the main body portion 162 and pivotal on cut-outs 167 in the side walls 130 of the frame 122. The blocking lever 160 further includes a step 169 between the blocking portion 168 and the main body portion 162 for cooperating with the locking member 136 in a manner to be described. The blocking lever 160 includes a stop 170 extending rearwardly from the main body portion 162 to contact the locking member 136 for a function to be described. The blocking lever 160 includes a step portion 171 extending forwardly and upwardly from the main body portion 162 for a function to be described. The blocking lever 160 is formed as a monolithic structure being integral, unitary and one-piece. It should be appreciated that the blocking lever 160 has the center of gravity 166 specifically located below its own pivot defined by the blocking portion 168 and a mass that is greater than the release button 132. It should also be appreciated that the apertures 180 provide an interface between the release button 132 and the blocking lever 160.

The seat restraint buckle assembly 110 includes a spring 172 extending longitudinally between the release button 132 and the blocking lever 160. The spring 172 is disposed over a projection 174 on the release button 132 and the blocking portion 168 of the blocking lever 160.

In normal operation, the seat restraint system 12 is illustrated in FIG. 11 in an unlatched or unbuckled position in which the latch plate 14 is removed from the seat restraint buckle assembly 110. To fasten or latch the seat restraint system 12, the latch plate 14 is inserted between the frame 122 and release button 132. The latch plate 14 contacts a leading surface on the actuator slider 152, compressing the spring 158, until the actuator slider 152 contacts the legs 144 of the locking member 136. As the latch plate 14 and actuator slider 152 continue to travel, the actuator slider 152 rotates the locking member 136 on the frame 122. The locking member 136 has the lock bar 140 that rotates and passes through the aperture 20 in the latch plate 14. As the locking member 136 rotates in a counterclockwise direction, a leading edge of the locking member 136 contacts the blocking lever 160 to rotate the blocking lever 160 in a clockwise direction. As the blocking lever 160 rotates, this rotation will compress the spring 172. As the locking member 136 rotates past the blocking lever 160, the stored energy in the spring 172 will act on the blocking lever 160 and rotate in a counterclockwise direction and the step 169 on the blocking lever 160 will lockup with the locking member 136. At this point, the seat restraint system 110 is in a latched or buckled position as illustrated in FIG. 9.

To unlatch the seat restraint system 12 during normal operation, an operator pushes or presses on the release button 132. The release button 132 makes contact with the detent portion 164 on the blocking lever 160 and rotates the blocking lever 160 in a clockwise direction, which will then lose contact with the locking member 136. As the locking member 136 rotates in a clockwise direction about a pivot on the frame 122, this rotation will remove the locking member 136 from the latch plate 14. The stored energy in the spring 158 will then push the actuator slider 152 forward and push the latch plate 14 out of the buckle assembly 110 and become unlatched.

When the seat restraint system 12 is in the latched position of FIG. 9 and the seat belt pretensioner has been deployed, the seat restraint buckle assembly 110 will experience very high acceleration and very rapid deceleration. During deceleration of the seat restraint buckle assembly 110, the release button 132 will translate in the axis of the seat restraint buckle assembly 110 and makes contact with the blocking lever 160 and attempts to rotate the blocking lever 160 in a clockwise direction. The blocking lever 160, with a center of gravity that is specifically located below its own pivot defined by the pin 166 and a mass that is greater than the release button 132, will rotate in a counterclockwise direction. As a result, the blocking lever 160 will maintain a latched or locked condition with the locking member 136 and retain the latch plate 14 to provide positive latching of the seat restraint buckle assembly as illustrated in FIG. 10.

Figure 10:
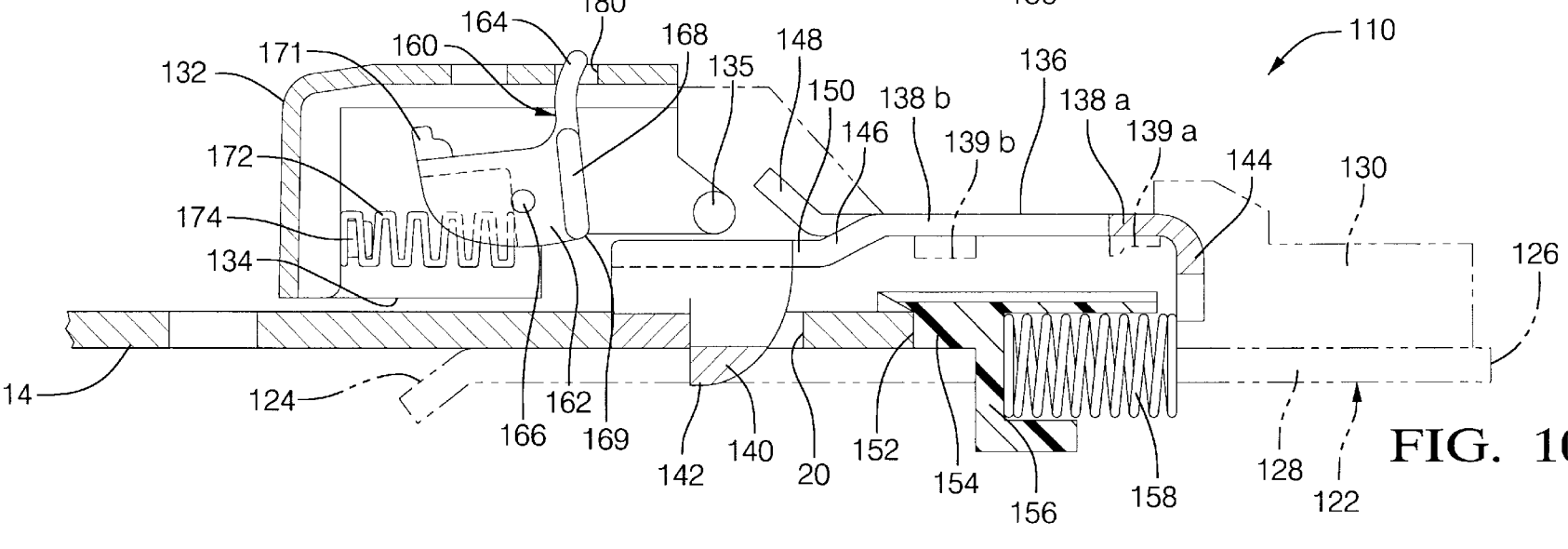
FIG. 10 is a view similar to FIG. 9 illustrating the seat restraint buckle assembly in a lever disengaged position.

Unlatching the seat restraint system 12 after the seat belt pretensioner has fired and all motion of the vehicle has ceased as illustrated in FIG. 10, the operator pushes or presses on the release button 132. The release button 132 makes contact with the detent portion 164 on the blocking lever 160 and rotates the blocking lever 160 in a clockwise direction, which will then lose contact with the locking member 36. As the locking member 136 rotates in a clockwise direction about a pivot on the frame 122, this rotation will remove the locking member 136 from the latch plate 14. The stored energy in the spring 158 will then push the actuator slider 152 forward and push the latch plate 14 out of the buckle assembly 110 and become unlatched. It should be appreciated that the mass of the release button 132 multiplied by the length of the pivot to button interface is less than the mass of the blocking lever 160 multiplied by length of the pivot to the center of gravity 166. It should also be appreciated that pre-travel of the release button 132 has been eliminated and the two equally spaced apertures 180 in the release button 132 control the motion of the blocking lever 160 at all times during travel.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A seat restraint buckle assembly for a seat restraint system in a vehicle comprising:

a rigid frame having an open forward end defining a passage to receive a latch plate;

a locking member operatively connected to said frame and pivotal between a latched position in which said locking member retains the latch plate within said passage and an unlatched position in which said locking member is held clear of said passage;

a release button slidably mounted on said frame above said passage for longitudinal movement relative to said frame;

a blocking lever operatively connected to said frame and pivotal to contact said locking member and urging said locking member towards said latched position when opposing forces are acting on said locking member, said blocking lever having a mass greater than said release button; and a spring disposed between said blocking lever and said release button to rotate said blocking lever to lock-up said locking member in said latched position.

2. A seat restraint buckle assembly for a seat restraint system in a vehicle comprising:

a rigid frame having an open forward end defining a passage to receive a latch plate;

a locking member operatively connected to said frame and pivotal between a latched position in which said locking member retains the latch plate within said passage and an unlatched position in which said locking member is held clear of said passage;

a release button slidably mounted on said frame above said passage for longitudinal movement relative to said frame;

a blocking lever operatively connected to said frame and pivotal to contact said locking member and urging said locking member towards said latched position when opposing forces are acting on said locking member;

a spring disposed between said blocking lever and said release button to rotate said blocking lever to lock-up said locking member in said latched position; and wherein said blocking lever comprises a main body portion and at least one detent portion extending from said main body portion for cooperating with said release button.

3. A seat restraint buckle assembly as set forth in claim 2 wherein said blocking lever further comprises a blocking portion extending laterally from said main body portion and forming a step with said main body portion for contacting said locking member.

4. A seat restraint buckle assembly as set forth in claim 2 wherein said release button includes at least one aperture extending therethrough to receive said at least one detent portion to control movement of said blocking lever.

5. A seat restraint buckle assembly as set forth in claim 2 wherein said blocking lever has a step portion extending forwardly and upwardly from said main body portion to contact said release button to limit movement of said blocking lever.

6. A seat restraint buckle assembly as set forth in claim 1 including an actuator slider disposed on said frame for contacting the latch plate and moving longitudinally to rotate said locking member on said frame.

7. A seat restraint buckle assembly as set forth in claim 1 wherein said frame comprises a base plate and an upstanding side wall extending from each longitudinal edge of said base plate.

8. A seat restraint buckle assembly as set forth in claim 1 wherein said release button includes a projection for one end of said spring.

9. A seat restraint buckle assembly as set forth in claim 1 wherein said blocking lever has a center of gravity below a pivot of said blocking lever.

10. A seat restraint buckle assembly as set forth in claim 1 wherein said release button is an end type push button.

11. A seat restraint buckle assembly as set forth in claim 1 wherein said locking member includes a depending portion engagable and disengagable with an aperture in the latch plate.

12. A seat restraint buckle assembly for a seat restraint system in a vehicle comprising:

a rigid frame having an open forward end defining a passage to receive a latch plate;

a locking member operatively connected to said frame and pivotal between a latched position in which said locking member retains the latch plate within said passage and an unlatched position in which said locking member is held clear of said passage;

a release button slidably mounted on said frame above said passage for longitudinal movement relative to said frame;

a blocking lever operatively connected to said frame and pivotal relative thereto, said blocking lever including a step contacting said locking member and urging said locking member towards said latched position, said blocking lever having a mass greater than said release button; and a spring disposed between said blocking lever and said release button to rotate said blocking lever to contact said step against said locking member in said latched position.

13. A seat restraint buckle assembly as set forth in claim 12 wherein said frame comprises a base plate and an upstanding side wall extending from each longitudinal edge of said base plate.

14. A seat restraint buckle assembly for a seat restraint system in a vehicle comprising:

a rigid frame having an open forward end defining a passage to receive a latch plate;

a locking member operatively connected to said frame and pivotal between a latched position in which said locking member retains the latch plate within said passage and an unlatched position in which said locking member is held clear of said passage;

a release button slidably mounted on said frame above said passage for longitudinal movement relative to said frame;

a blocking lever operatively connected to said frame and pivotal relative thereto, said blocking lever including a step contacting said locking member and urging said locking member towards said latched position;

a spring disposed between said blocking lever and said release button to rotate said blocking lever to contact said step against said locking member in said latched position; and wherein said blocking lever comprises a main body portion and a plurality of detent portions extending from said main body portion and cooperating with said release button.

15. A seat restraint buckle assembly as set forth in claim 14 wherein said release button includes a plurality of apertures extending therethrough to receive said detent portions to control movement of said blocking lever.

16. A seat restraint buckle assembly as set forth in claim 15 wherein said blocking lever has a center of gravity below a pivot of said blocking lever.

17. A seat restraint buckle assembly as set forth in claim 15 including an actuator slider slidably mounted on said base plate of said frame for longitudinal movement relative to said frame upon contacting the latch plate to rotate said locking member on said frame.

18. A seat restraint buckle assembly as set forth in claim 15 wherein said blocking lever has a step portion for contacting said release button to limit movement of said blocking lever.

19. A seat restraint buckle assembly as set forth in claim 15 wherein said blocking lever has a blocking portion extending laterally from said main body portion.

20. A seat restraint system for a vehicle comprising:

a latch plate operatively connected to vehicle structure and having an aperture therein;

a seat restraint buckle operatively connected to vehicle structure for receiving said latch plate;

said seat restraint buckle comprising a rigid frame having an open forward end defining a passage to receive said latch plate, a locking member operatively connected to said frame and pivotal between a latched position in which said locking member retains said latch plate within said passage and an unlatched position in which said locking member is held clear of said passage, a release button slidably mounted on said frame above said passage for longitudinal movement relative to said frame, a blocking lever operatively connected to said frame and pivotal relative thereto, said blocking lever comprising a main body portion and at least one detent portion extending from said main body portion for cooperating with said release button and including a step portion contacting said locking member and urging said locking member towards said latched position, and a spring disposed between said blocking lever and said release button to rotate said blocking lever to contact said step portion against said locking member in said latched position.

* * * * *